US005259093A

United States Patent [19]

D'Annunzio

[11] Patent Number: 5,259,093

[45] Date of Patent: Nov. 9, 1993

[54] STRAP CONNECTOR

[75] Inventor: Tim D'Annunzio, Raeford, N.C.

[73] Assignee: JS Industries, Inc., Smithfield, N.C.

[21] Appl. No.: 848,121

[22] Filed: Mar. 9, 1992

[51] Int. Cl.[5] ..... A44B 21/00

[52] U.S. Cl. ..... 24/3 R; 224/253; 383/22; 383/86

[58] Field of Search ..... 24/3 R, 683, 198, 200; 224/253; 2/338, 244; 150/118, 119; 383/22, 86

[56] References Cited

U.S. PATENT DOCUMENTS

| | | | |
|---|---|---|---|
| 1,638,073 | 8/1927 | Van Heusen | 24/3 R X |
| 1,688,699 | 10/1928 | Gardner, Jr. | 383/86 X |
| 1,907,657 | 5/1933 | Ottinger | 383/86 X |
| 3,294,135 | 12/1966 | Brenner | 383/86 X |

*Primary Examiner*—James R. Brittain

*Attorney, Agent, or Firm*—Robert G. Rosenthal

[57] ABSTRACT

A quick release connector system comprises an anchor and a strap. The anchor includes a base and a first guideway overlying the base connected thereto and defining a channel. A second guide overlies the base and is simultaneously connected thereto and defines a second channel. The channels are in substantial alignment with each other. A strap has a proximal end and a distal end having a stiffened segment. The proximal end is connected to an accessory to be connected to the anchor. A connector is formed and the strap is firmly and securely connected to the anchor when the distal end of the strap is directed in a first direction through the first channel and is looped in the opposite direction in the second channel so that at least a portion of the stiffened segment rests within the second channel.

8 Claims, 12 Drawing Sheets

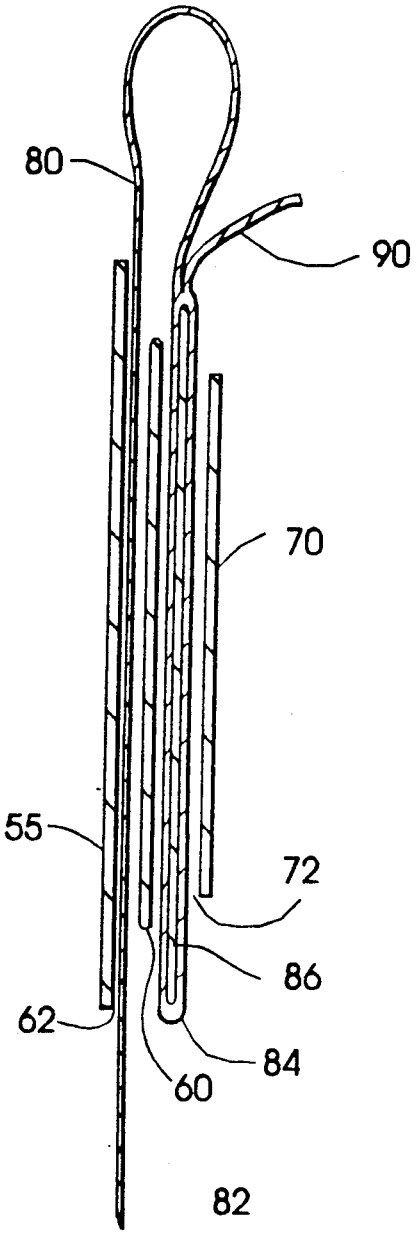
FIG. 5
FIG. 6
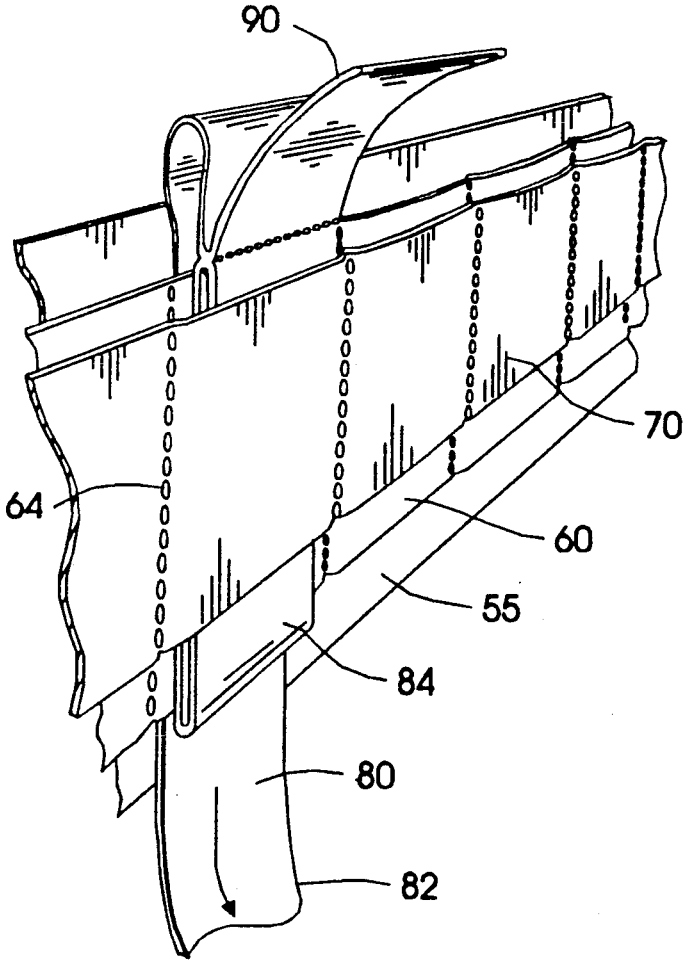

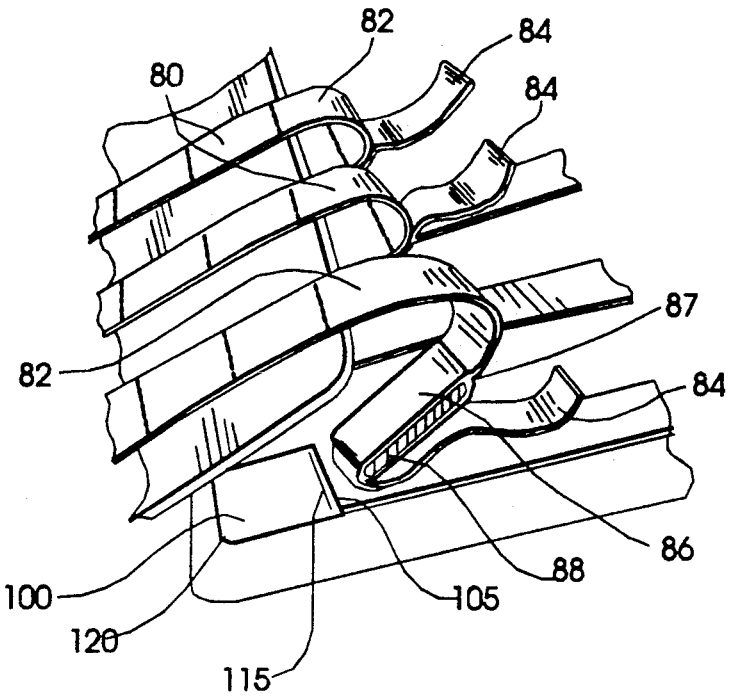
FIG. 9
FIG. 10
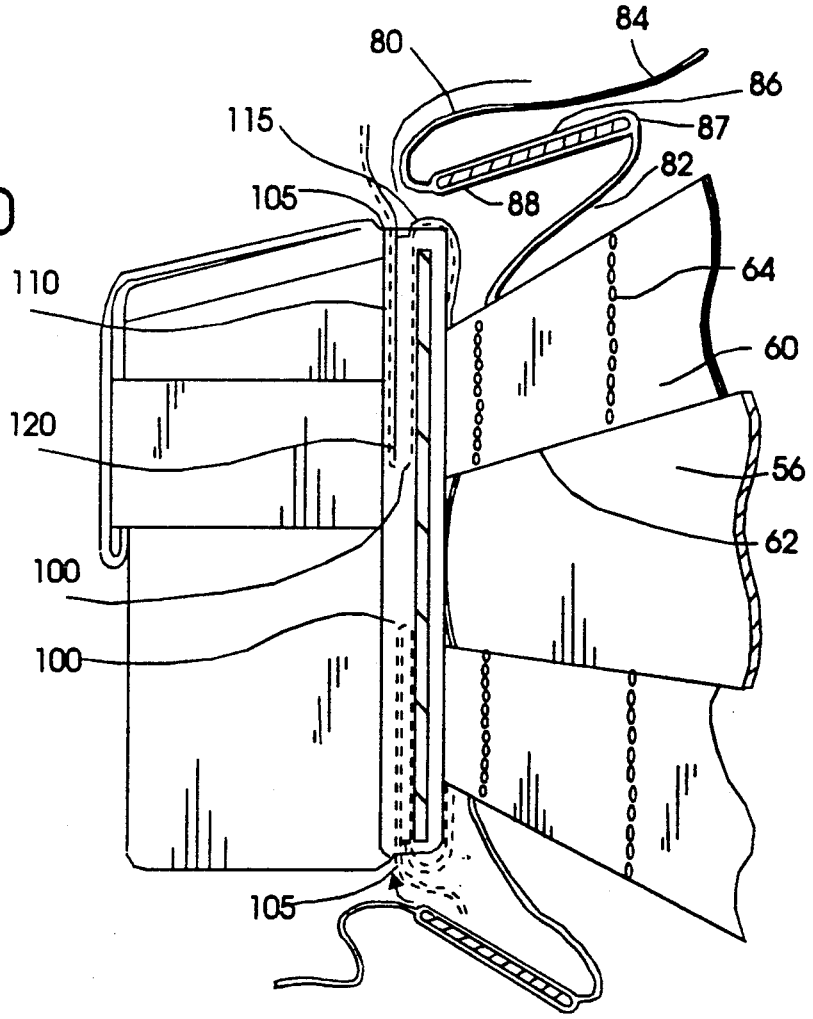

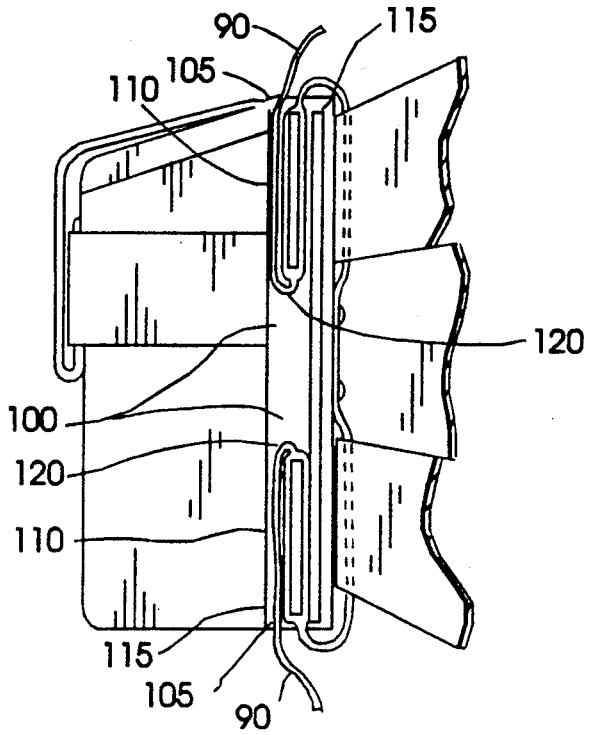
FIG. 11
FIG. 12
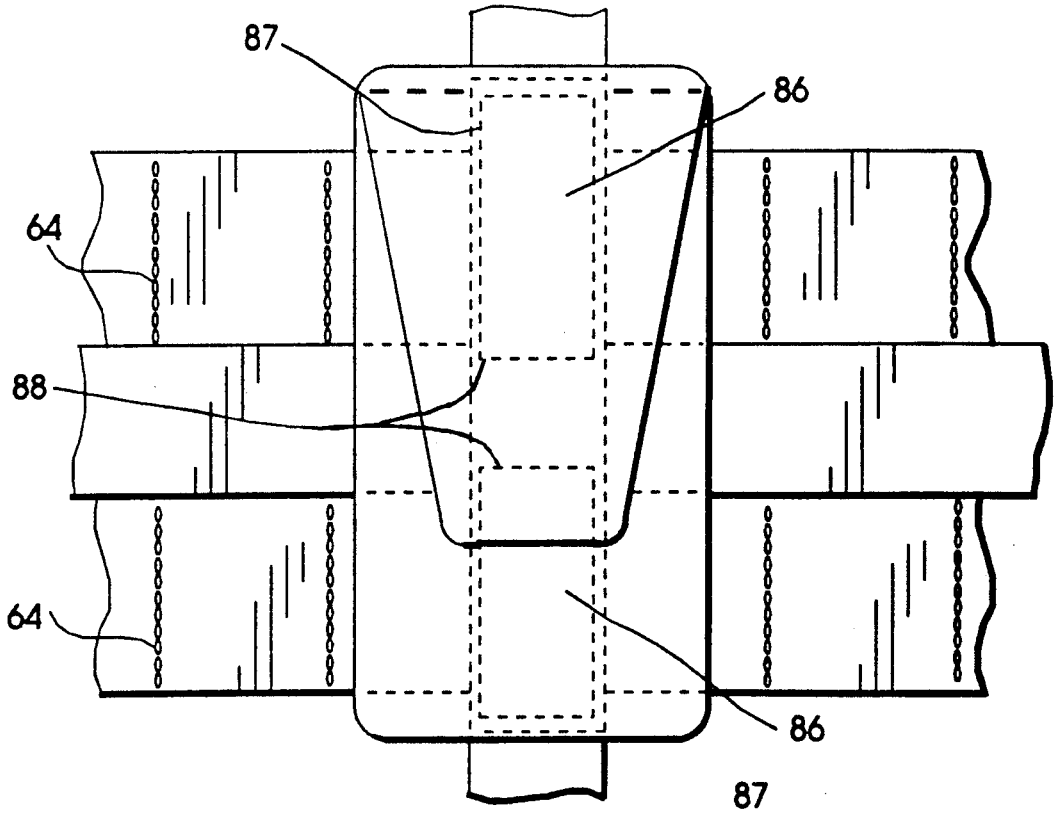

FIG. 19
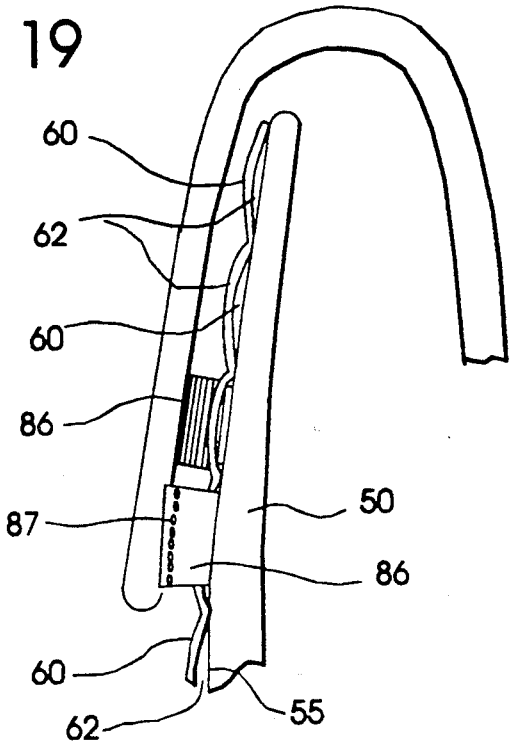
FIG. 21
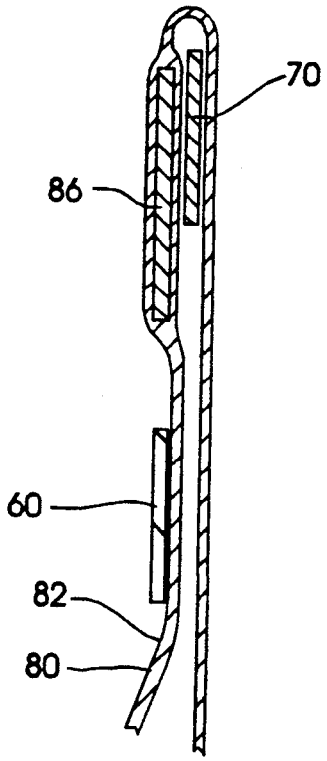
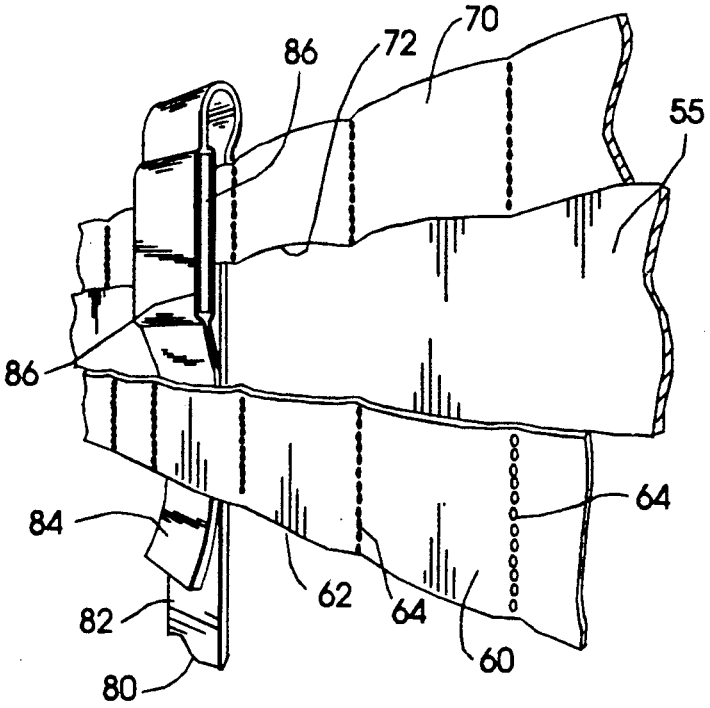
FIG. 20

STRAP CONNECTOR

FIELD OF THE INVENTION

This invention relates generally to the field of connectors and more particularly to the field of quick release connectors.

BACKGROUND OF THE INVENTION

Connectors of the type that join one component to another, such as a canteen, ammunition storage pouch, etc. to a belt are well known. These connectors may take the form of a metal ring attached to the belt and a metal clip that includes a movable member that hooks on to the aforementioned ring.

Also well known are connectors that join the opposite ends of a belt, dog collar, and the like. These connectors often include plastic connectors or buckles with male and female members located on opposite ends that snap together. When it is desired to release the buckle, the male member is compressed and becomes movable out of the female member.

However, connectors such as the foregoing are not without their inherent drawbacks and disadvantages. For example, the plastic buckles referred to above require a significant monetary and time investments in order to produce molds and further, require expensive molding equipment in order to produce its constituent parts.

On the other hand, metal connectors are also expensive as complex metal forming operations such as stamping and/or molding must be performed.

Aside from the monetary considerations referred to above, the connectors of the prior art are also deficient in other respects. For example, situations exist where it would be desirable to effect a connection in a noiseless manner. Similarly, other situations exist where it would be desirable to have a connector which is soft and which will not chafe or rub the user after extended use.

Accordingly, it is an object of this invention to provide an improved connector that is simple to manufacture and easy to use.

A more specific object of this invention is to provide an improved connector without metal or molded plastic parts.

Another object of this invention is to provide an improved connector wherein the constituent parts thereof can be connected or disconnected without noise.

Still another object of this invention is to provide an improved connector that does not rub or chafe the user.

Yet another object of this invention is to provide an improved connector that is rust free.

A further object of this invention is to provide an improved connector that is flexible.

SUMMARY OF THE INVENTION

These and other objects are accomplished by providing a quick release connector system comprising an anchor means and a strap means. The anchor means includes a base means and a first guide means overlying the base means and connected thereto and defining a first channel. A second guide means overlies the base means and is similarly connected thereto and defines a second channel therebetween. In addition, portions of the first and second channels are in substantial alignment. The strap means has a proximal end and a distal end and includes a stiffened segment along its length.

Thus, a connector is formed and the strap means is firmly and securely connected to the anchor means when the distal end of the strap means is directed in a first direction through the first channel and is looped in the opposite direction in the second channel so that at least a portion of the stiffened segment comes to rest within the second channel.

BRIEF DESCRIPTION OF THE DRAWINGS

Some of the features of the invention having been stated, other objects will appear as the description proceeds, when taken in connection with the accompanying drawings in which—

FIG. 5 is an exploded side view of the belt of figures 1 and 2 illustrating the path of travel of the strap through the various layers of the anchor.

FIG. 6 is a perspective view of a portion of the belt of FIGS. 1 and 2 illustrating the strap connected to the anchor and being ready to bear a load.

FIG. 9 is a partial perspective view of the front portions of the vest of FIG. 7 illustrating the opposite front panels of the vest being connected with the connector according to the present invention.

FIG. 10 a side view of an accessory being connected to a panel of the vest by employing a pair of connectors according to the present invention.

FIG. 11 is another side view of an accessory after connection thereof to the vest panel is complete according to the present invention.

FIG. 12 is a broken away front view of an accessory connected to the vest of FIG. 7 and illustrating the connector according to the present invention.

FIG. 19 is a side view of the embodiment of the connector of FIG. 17 according to the present invention.

FIG. 20 is a perspective view of still another embodiment of the connector according to the present invention.

FIG. 21 is a side view of the connector of FIG. 20 according to the present invention.

DETAILED DESCRIPTION OF THE ILLUSTRATED EMBODIMENTS

Figure 1:
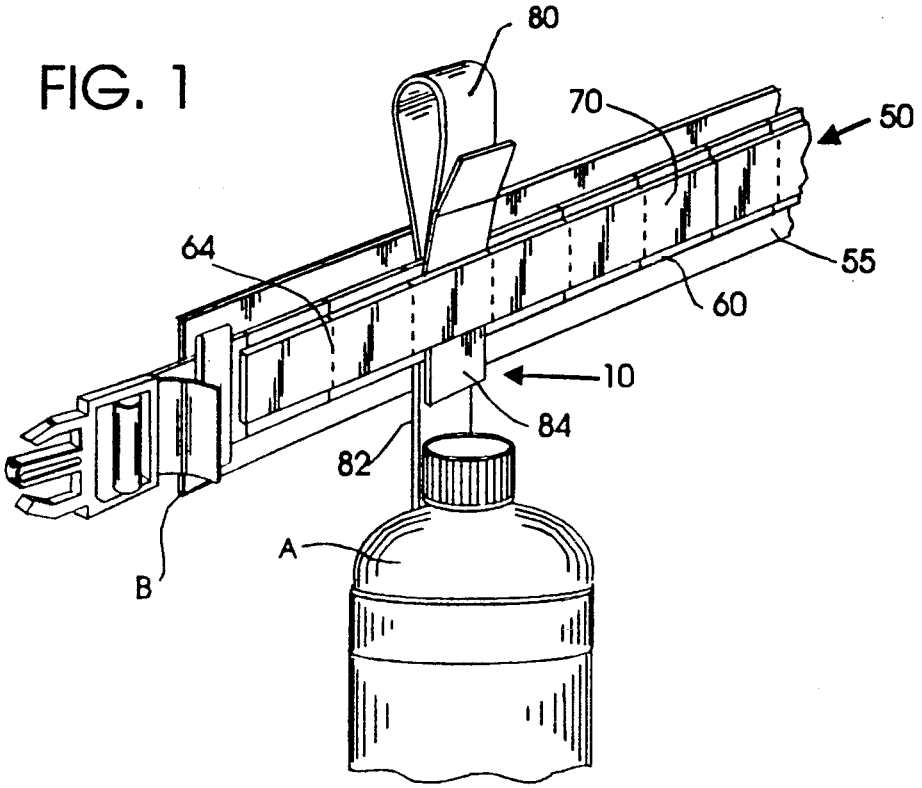
FIG. 1 is a perspective view of a portion of a belt embodying the connector of the present invention to which a water bottle is attached.
Figure 2:
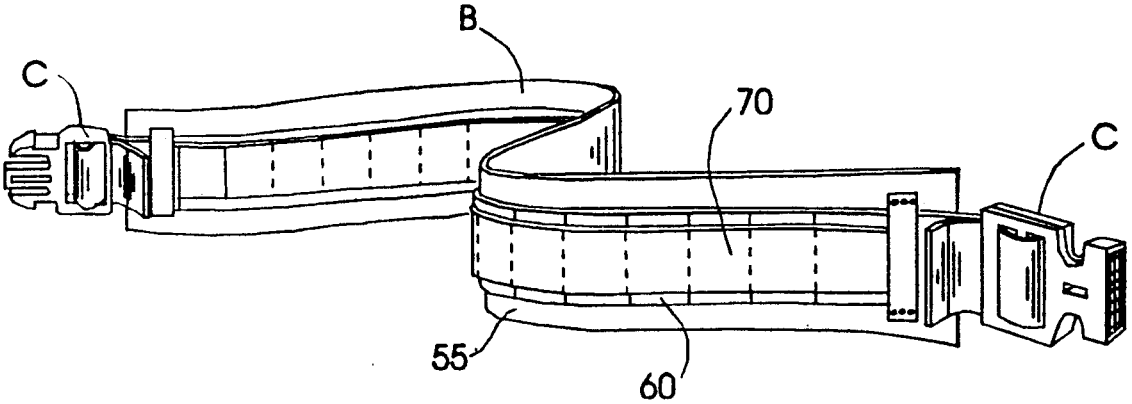
FIG. 2 is a perspective view of the entire belt as illustrated in FIG. 1 embodying the connector of the present invention.
Figure 3:
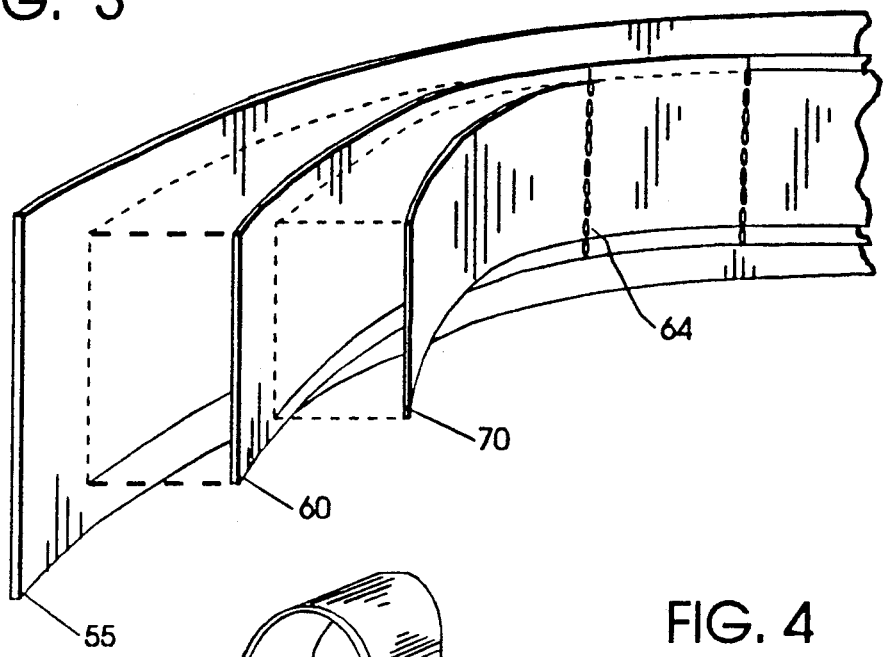
FIG. 3 is an exploded side view of the belt of figures 1 and 2 and showing the layers of the anchor according to the present invention.
Figure 4:
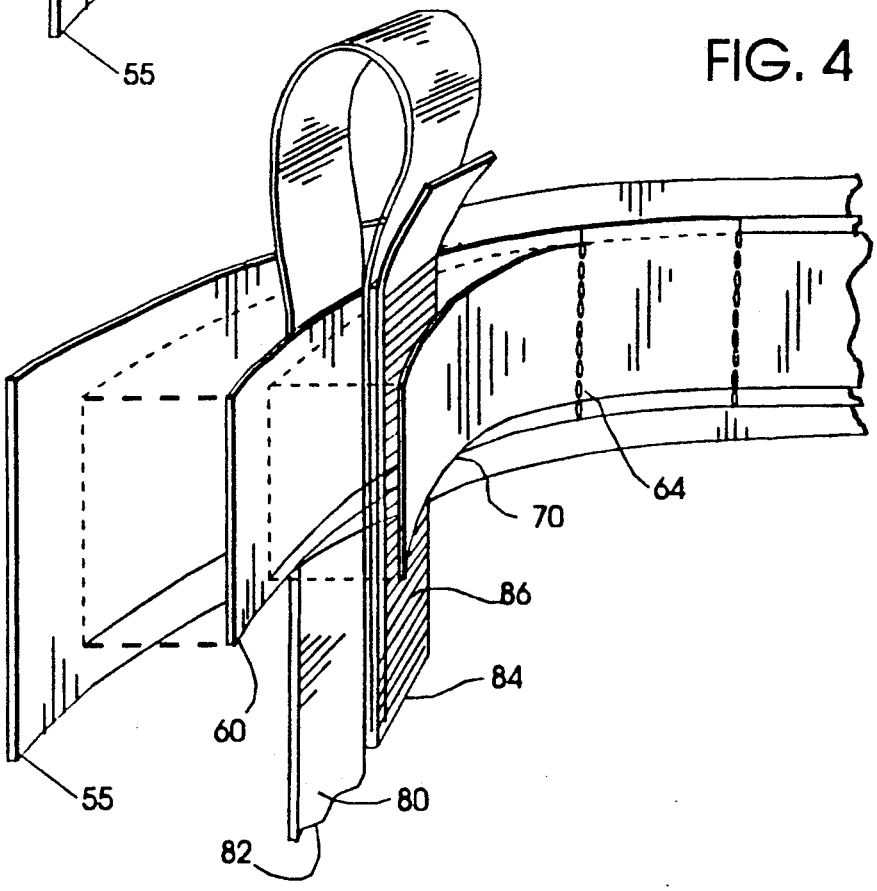
FIG. 4 is an exploded side view of a portion of the belt as shown in the figures, illustrating the layers of the anchor portion of the connector.
Figure 7:
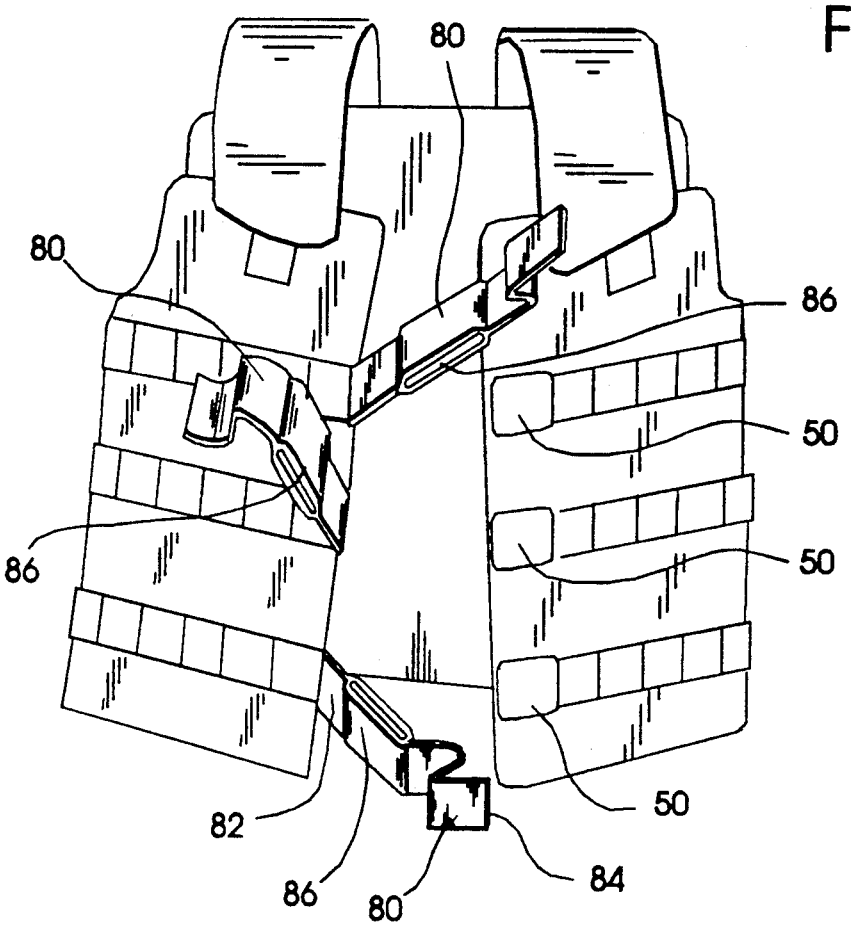
FIG. 7 is a front view of a vest adapted to be closed with the connector according to the present invention.
Figure 8:
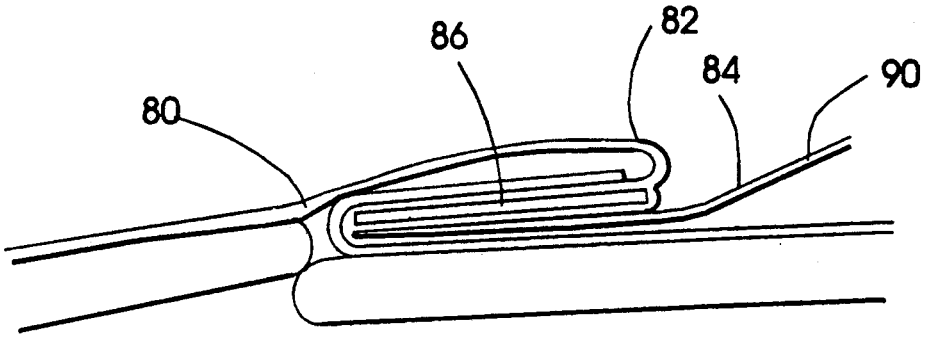
FIG. 8 is a cross-sectional view of the connector of FIG. 7 according to the present invention in the closed position.
Figure 13:
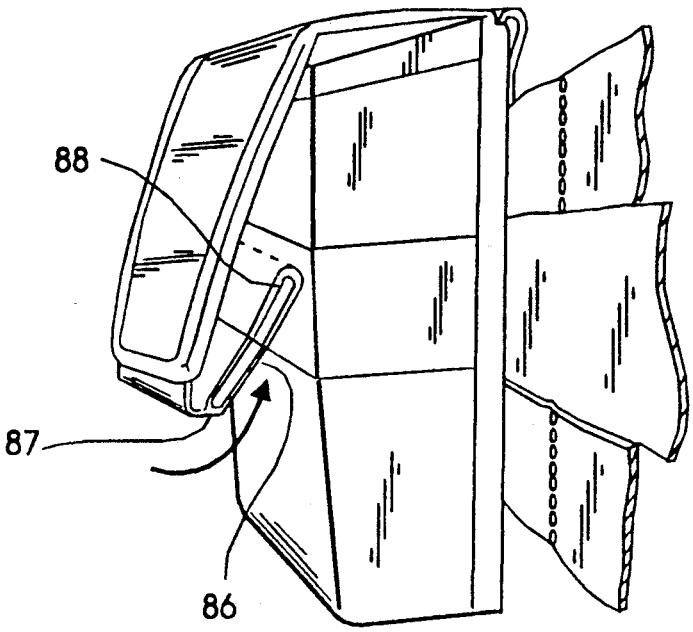
FIG. 13 is a perspective view of the closure f lap of an accessory being closed by employing a connector according to the present invention.
Figure 14:
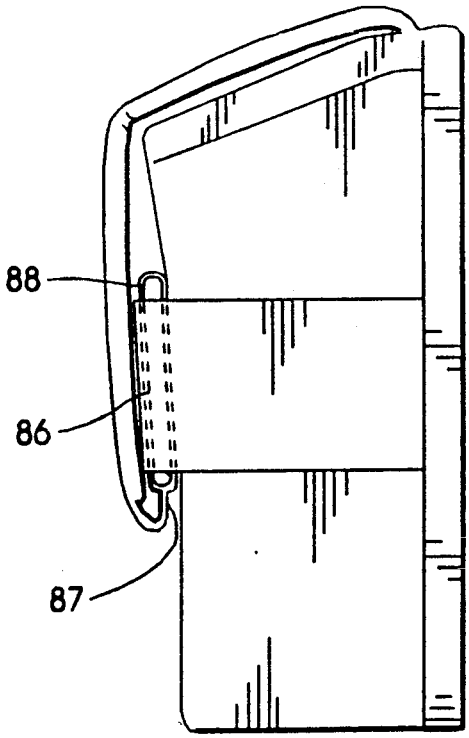
FIG. 14 is a side view of the accessory of FIG. 13 with the closure f lap in the closed position by employing a connector according to the present invention.
Figure 15:
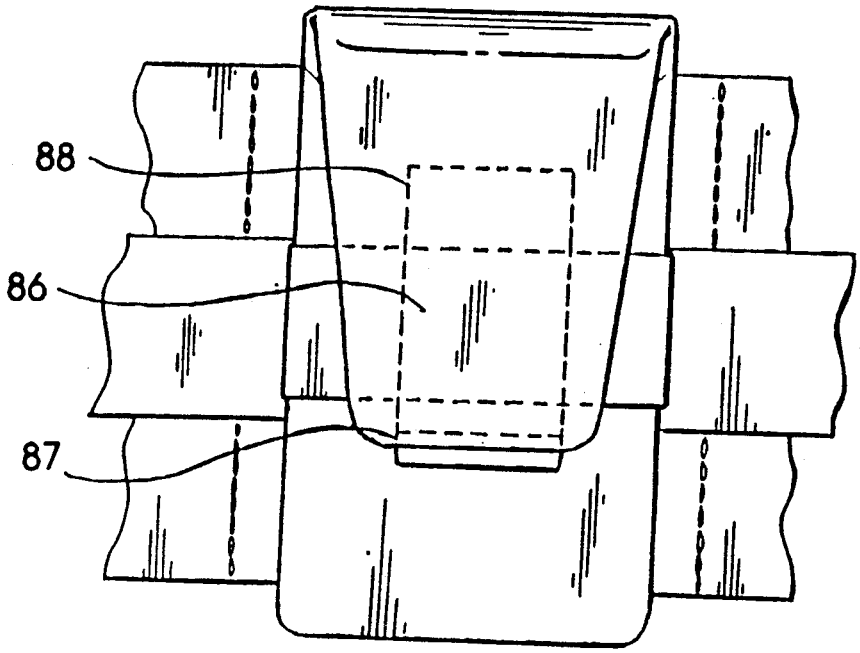
FIG. 15 is a broken away front view of the accessory of FIG. 13 showing the closure flap in the closed position by employing a connector according to the present invention.
Figure 16:
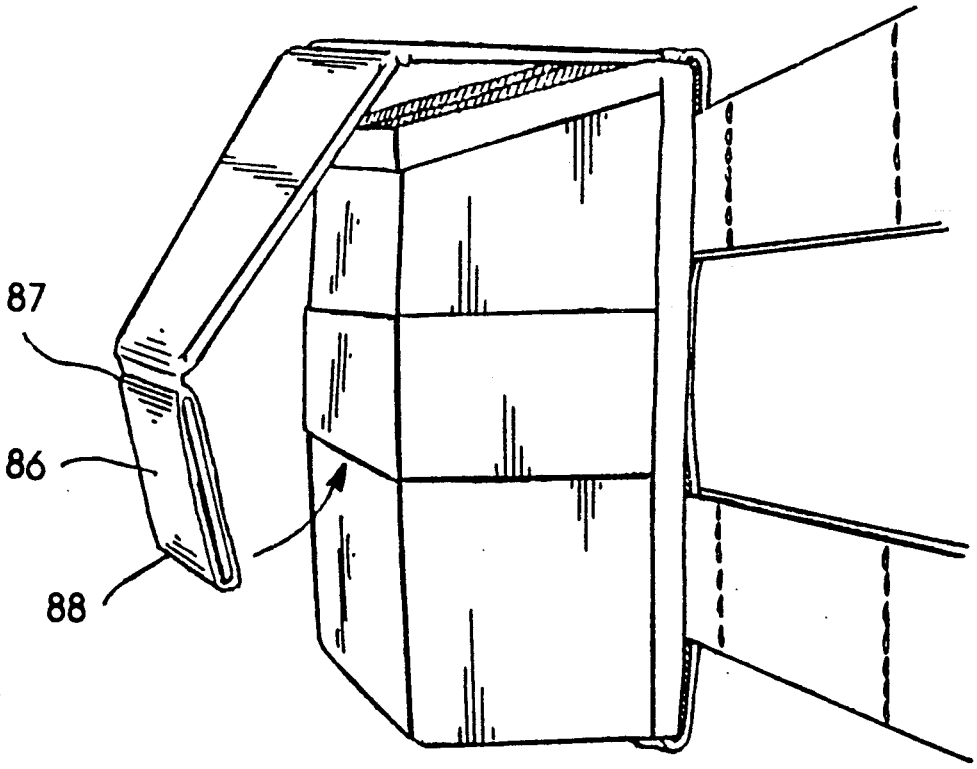
FIG. 16 is a perspective view of the accessory of FIG. 13 showing the path of travel of the strap portion of the closure flap and its insertion beneath the anchor portion of the connector according to the present invention.

While the present invention will be described more fully hereinafter, it is to be understood at the outset that persons of skill in the art may modify the invention herein described while still achieving the favorable results of this invention. Accordingly, the description which follows is to be understood as being a broad teaching disclosure directed to persons of skill in the appropriate arts, and not as limiting upon the present invention.

Referring now more particularly to the drawings and specifically to FIGS. 1 through 6, there is illustrated a first embodiment of the connector, of the present invention generally indicated at 10. The connector comprises an anchor means 50 and a strap means 80. It will be noted that the connector 10 is illustrated as being useful to attach accessories A such as water bottles and/or storage pouches of varying sizes to a belt B. As illustrated, the belt B may include commonly used buckles C at each of its respective ends. However, it is to be emphasized that the use of the connector of the present invention has broad application beyond the belt example given.

The anchor means 50 comprises a base means 55, a first guide means 60, and a second guide means 70. The base means or base 55 may take the form of any type of substrate such as a belt, vest, backpack or any other support to which an item is to be detachably connected. A first guide means or guide 60 overlies the base 55 and is connected thereto. The space between the base 55 and the first guide means 60 defines a first channel 62. A second guide means or second guide 70 overlies the first guide 60 and is similarly connected to the base 55. The space between the first and second guides 60,70 defines a second channel 72. As will be observed from FIGS. 1 through 6, both the first and second guide means 60,70 are tacked with vertical rows of stitching 64 to the base 55. The reader will note that the first guide means 60 is slightly greater in width than the second guide means 70. Furthermore, both guide means 60,70 in the prototype that was constructed were fabricated from elongate strips of NYLON ® webbing. Moreover, it will be observed from the figures, that multiple anchoring positions may be created by tacking the guide means 60,70 to the base 55 at multiple locations along their length. In this manner, multiple articles may be anchored adjacent each other at desired locations along the belt. However, for the sake of clarity, only a single connector is discussed herein.

The strap means or strap 80 comprises a predetermined length of flexible material (such as a NYLON ® webbing), has a proximal end 82 adapted to bear a load such as accessory A and a distal end 84. The strap 80 further includes a stiffened segment 86 along a portion of its length. As will be seen from the figures, the stiffened segment is located proximate the distal end 84 of the strap 80. Specifically, the stiffened segment 86 is formed by folding the strap over a piece of semi-rigid material (such as a plastic) and fixing its location by suitable means such as by sewing, gluing, or fusing it in the desired location. However, it is contemplated that other methods of forming the stiffened segment may be employed, such as applying an adhesive at the specified location or by other methods well known to those skilled in the art. Furthermore, a quick release means 90 is also provided near the stiffened segment, as will become apparent from the discussion which follows.

In operation, the distal end 84 of strap 80 is directed in a first direction in the first channel 62 and is then looped in the opposite direction and the distal end 84 is inserted into the second channel 72 so that at least a portion of the stiffened segment 86 rests within the second channel. The strap is held in place by the mechanical advantage created thereby. It will easily be seen that it requires a great quantity of downward force (as indicated by the arrow in FIG. 6) on the proximal end of the strap 80 to dislodge the stiffened segment 86 from the second channel 72.

Conversely, when it is desired to remove the strap 80 from the anchor, the user need merely push upward on the distal end 84 or pull upward on the quick release tab 90 which will release the strap from within the second channel 72 and pull downward on the strap to remove the strap 80 from the first channel 62. Furthermore, provision is made for the smooth passage of both the stiffened segment 86 and the quick release tab 90 through the first channel 62. This is accomplished by maintaining the outer surfaces of the strap 85 as smooth as possible and it is, therefore, preferred for the stiffened segment to be positioned within the strap. Similarly the quick release tab 90 folds flush back against the strap and is easily passed through the first channel 62.

The following embodiments are similar in many respects to that previously described in detail. To enhance the clarity of the explanation that follows, the same reference numerals have been used wherever possible.

A second embodiment of the connector according to the present invention is illustrated in FIGS. 7 through 12. While these illustrations are given with respect to a garment, and particularly a vest, it is to be understood that the particular example is exemplary of use of many applications therefor. In further accordance with the invention, there is provided an anchor 50 comprising a base 55 and a pocket means or pocket 100. The pocket 100 is adapted to be connected to the base 55 and includes an opening 105 defining a cavity 110 having an access end 115 and a terminating end 120. As illustrated in the figures, the pocket is elongate and substantially flat. It may be formed by tacking a section of NYLON ® webbing along three of its sides to the base 55. Alternatively, a single channel configuration previously discussed with reference to FIGS. 1 through 6 could be substituted for the pocket 100, depending upon application.

With reference to the strap means or strap 80, this is structurally similar to that previously discussed. Specifically, the strap 80 comprises a proximal end and a distal end. The proximal end is adapted to be connected to base 55. Located approximately at the middle one-third of the strap is the stiffened segment 86 also having a proximal end 87 and a distal end 88. This configuration serves to obviate the need for a quick release means 90.

In operation, the distal end 87 of the stiffened segment 86 is inserted within the pocket 100 so that it rests proximate the terminating end 120 thereof. This causes the distal one-third of the strap to overlap and contact the stiffened segment, and further, a section thereof protrudes out of the access end 115 of the pocket 100. Thus, when one desires to remove the strap, it is only required that the protruding distal portion thereof be pulled. Again, a firm connection is maintained because significant force is required to deform the stiffened section to a degree where it will become dislodged from within the pocket.

FIGS. 10 through 12 illustrate the above connector being used in conjunction with a storage pouch having an upper and a lower point of attachment. The operation is identical to that discussed above, but is an excellent example of the versatility of the connector in an inverted mode.

FIGS. 13 through 16 illustrates the use of the present invention in an accessory pouch to maintain its covering or lid in the closed position. Specifically, a stiffened segment 86 is connected to the end of the lid. When it is desired to close the pouch, the stiffened segment is slightly bent and is inserted within a channel defined by the space between the pouch covering and a webbing or strip connected thereto.

Figure 17:
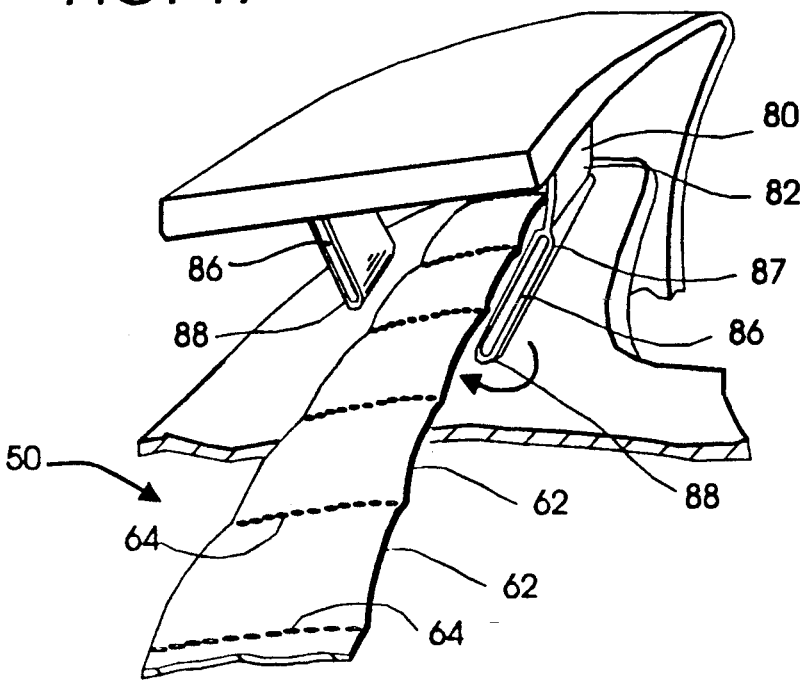
FIG. 17 is a perspective view of another embodiment of the connector according to the present invention.
Figure 18:
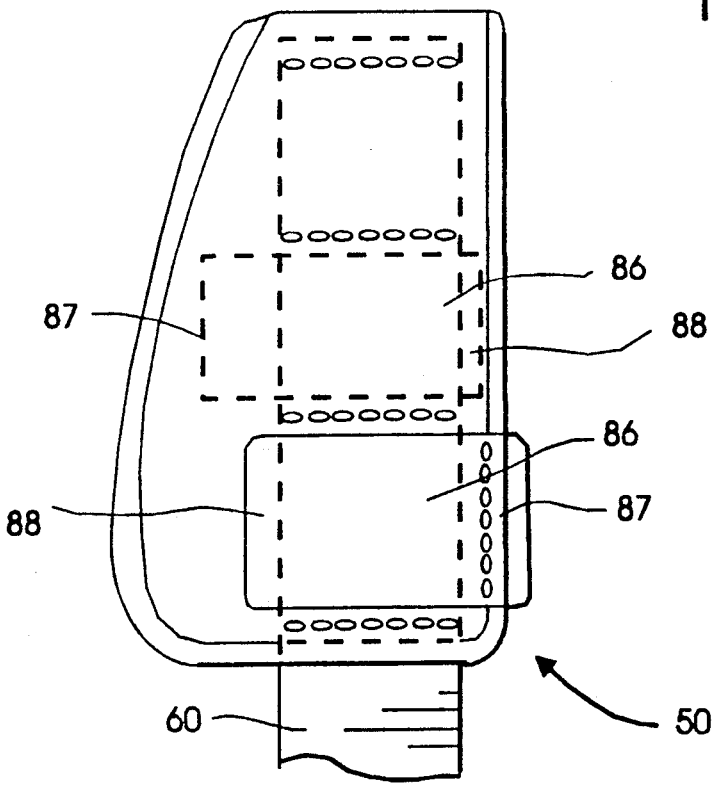
FIG. 18 is a broken away plan view of the embodiment of the connector of FIG. 17 according to the present invention.

FIGS. 17 through 19 illustrate another application of the connector of the present inventions i.e., oppositely pointing offset stiffened segments may be used to connect a structure such as a shoulder pad to a base 55. The distal ends 88 of each of the respective stiffened segments 86 are inserted from opposite directions into longitudinally spaced apart channel segments 62, again forming a firm and secure connection.

FIGS. 20 and 21 illustrate a further variation in the connector as shown in FIGS. 1 through 6. In this embodiment, the first guide means 60 overlies the base 55 and is connected thereto to define a first channel 62 therebetween. A second guide means 70 is also provided and also overlies the base 55, but does not overlie the first guide means 60. The second guide means 70 is connected to the base and defines a second channel 72 therebetween. However, in this example at least a portion of the first and second channels 62,72 are in substantial alignment. Thus, when an accessory A or load is attached to the proximal end 82 of the strap 80, connection of the distal end where the stiffened segment 86 is located is effected by guiding the stiffened segment through the first and second channels 62,72, looping it around and inserting it into only the first encountered channel to secure its position and the mechanical advantage thus obtained.

Figure 22:
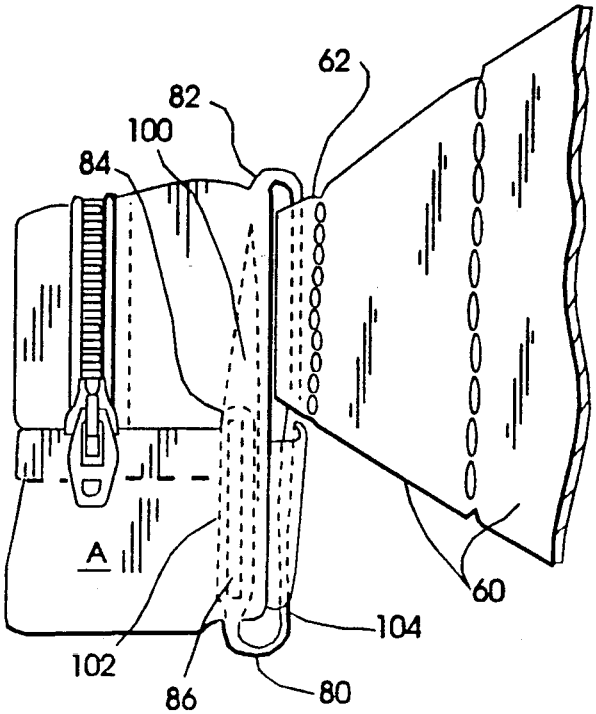
FIG. 22 is a side view partially broken away of yet another embodiment of the connector according to the present invention and illustrating the connector being utilized in conjunction with a detachable pocket.
Figure 23:
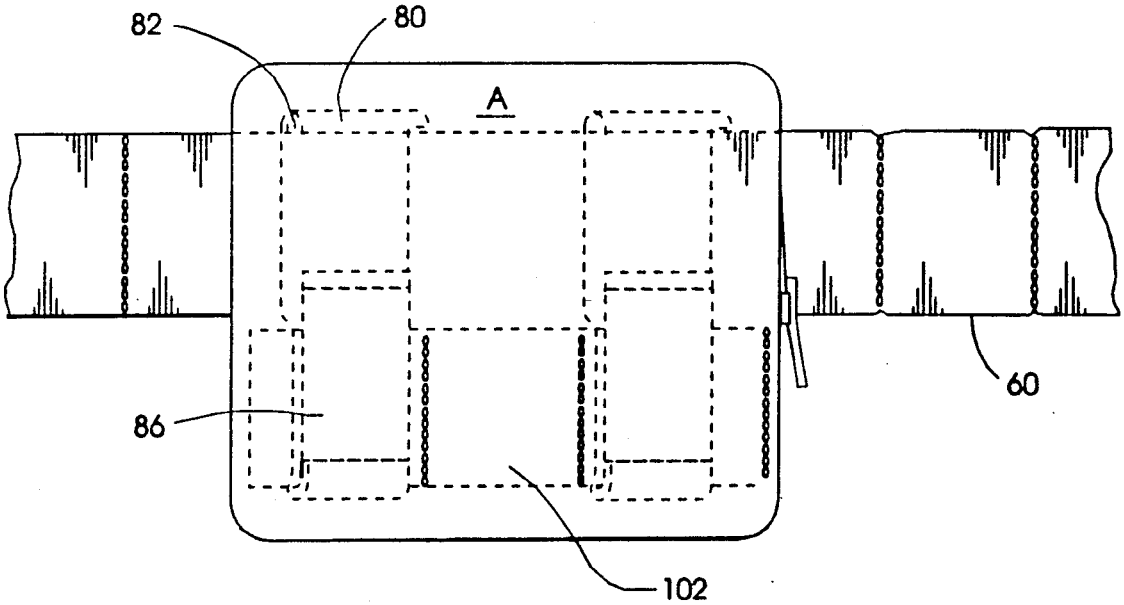
FIG. 23 is a rear view of the embodiment of the connector of FIG. 22 according to the present invention and showing the pocket attached to a supporting structure.
Figure 24:
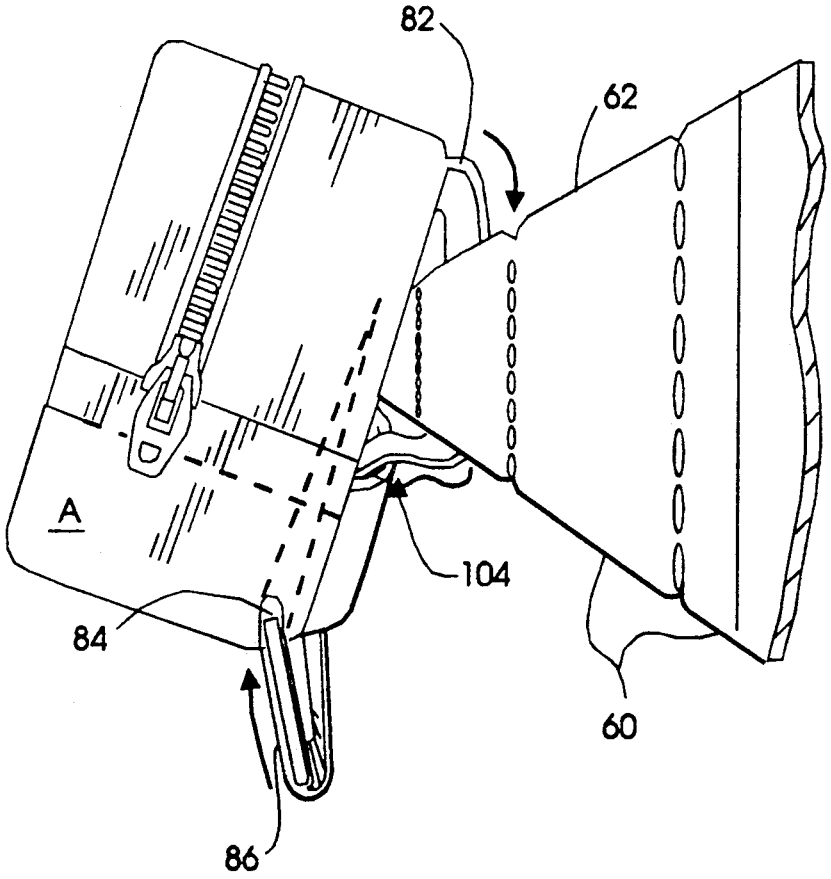
FIG. 24 is a side view of the embodiment of the connector of FIG. 22 according to the present invention and showing the pocket in the process of being attached to a supporting structure.

FIGS. 22 through 24 illustrate another variation of the connector 10. In this embodiment, a first base means 55 is operatively associated with the support and may actually be the outer layer of the support itself. A first guide means 60 overlies the base means and is connected thereto defining a first channel 62 therebetween. A second base means 102 is provided and is operatively associated with the accessory and defines a pocket 100 therebetween. A second elongate guide means 103 overlies the second base means 102 and is connected thereto defining a second channel 104 therebetween. Also provided is a strap means 80 having a proximal end 82 and a distal end 84. The proximal end 82 is connected to the accessory and the strap means 80 further includes a stiffened segment 86 along a portion of its length, preferably near the distal end 84. Thus, when the stiffened segment 86 is threaded through the first and second channels 62,104 in a first direction and is looped in the opposite direction so that it rests within the pocket 100, the accessory is held in place by the mechanical advantage created.

The foregoing embodiments and examples are to be considered illustrative, rather than restrictive of the invention, and those modifications which come within the meaning and range of equivalence of the claims are to be included therein.

That which is claimed is:

1. A quick release connector system comprising:

an anchor means comprising:

a base means;

a first guide means overlying said base means connected thereto and defining a first channel therebetween;

a second guide means overlying said first guide means connected to said base means and defining a second channel therebetween; and a strap means comprising a predetermined length of a flexible material having a proximal end and a distal end, and wherein said strap means includes a stiffened segment along a portion of its length;

whereby said strap means is firmly and securely connected to said anchor means when one end of said strap means is directed in a first direction in said first channel and is looped the opposite direction in said second channel so that at least a portion of said stiffened segment comes to rest within said second channel.

2. A quick release connector according to claim 1 wherein said strap means further includes a plurality of spaced apart stiffened segments.

3. A quick release connector according to claim 1 wherein said strap means further includes gripping means.

4. A quick release connector according to claim 3 wherein said gripping means is positioned proximate an end of said stiffened segment.

5. A quick release connector system comprising:

an anchor means comprising:

a base means, a first guide means overlying said base means connected thereto and defining a first channel therebetween, a second guide means overlying said base means connected thereto and defining a second channel therebetween and wherein at least a portion of said first and second channels are in substantial alignment; and a strap means comprising a predetermined length of a flexible material having a proximal end and a distal end, and wherein said strap means includes a stiffened segment along a portion of its length;

whereby said strap means is firmly and securely connected to said anchor means when one end of Said strap means is directed in a first direction in said first channel and is looped in the opposite direction in said second channel so that at least a portion of said stiffened segment comes to rest within Said second channel and is held in place by the mechanical advantage created by the stiffened segment.

6. A quick release connector system comprising:

an anchor means comprising, a base means, a first guide means overlying said base means connected thereto and defining a first channel therebetween, a second guide means overlying said base means connected thereto and defining a second channel therebetween, said first and second channels being in substantial alignment; and a strap means having a proximal end and a distal end, and wherein said strap means includes a stiffened segment along a portion of its length;

whereby said strap means is firmly and securely connected to said anchor means when one end of said strap means is directed in a first direction in at least one of said channels and is looped in the opposite direction in the other of said channels so that at least a portion of said stiffened segment rests within the other of said channels and is held in place by the mechanical advantage created by the stiffened segment.

7. A quick release connector system comprising:

an anchor means comprising:

a base means, an elongate guide means overlying said base means connected thereto and defining a channel therebetween;

a first strap means having a proximal end and a distal end, and wherein said strap means includes a stiffened segment along a portion of its length, said proximal end adapted to be connected to an item to be attached, a second strap means having a second proximal end and a second distal end, and wherein said strap means includes a stiffened segment along a portion of its length, said second proximal end adapted to be connected, to an item to be connected to the item to be attached, said respective proximal and second proximal ends are connected in spaced apart relation, whereby when said distal end and said second distal end and at least a portion of said stiffened segments are placed within said channel, the item to be attached is securely and firmly connected to the base means by mechanical advantage at the stiffened segments.

8. A quick release connector system for releasably connecting an accessory to a support and comprising:

a first base means operatively associated with the support;

a first guide means overlying said base means connected thereto and defining a first channel therebetween;

a second base means operatively associated with the accessory and defining a pocket therebetween;

a second elongate guide means overlying said second base means connected thereto and defining a second channel therebetween;

a strap means having a proximal end and a distal end; said proximal end being connected to said accessory, said strap means further including a stiffened segment along a portion of its length, whereby when said stiffened segment is threaded through said first channel and said second channel in a first direction and is looped in the opposite direction so that said stiffened segment rests within said pocket, the accessory is held in place by the mechanical advantage created by the stiffened segment.

* * * * *